US006478093B1

(12) United States Patent
Hilts et al.

(10) Patent No.: US 6,478,093 B1
(45) Date of Patent: Nov. 12, 2002

(54) RETRIEVABLE WELL PACKER APPARATUS AND METHOD

(75) Inventors: Robert L. Hilts, Carrollton, TX (US); Marion Dewey Kilgore, Dallas, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 6 days.

(21) Appl. No.: 09/676,136

(22) Filed: Sep. 29, 2000

(51) Int. Cl.[7] ..... E21B 33/12; E21B 29/02; E21B 33/128

(52) U.S. Cl. ..... 166/387; 166/120; 166/181; 166/123; 166/55

(58) Field of Search ..... 166/118, 55, 120, 166/123, 181, 387

(56) References Cited

U.S. PATENT DOCUMENTS

| | | | | | |
|---|---|---|---|---|---|
| 2,918,125 | A | * | 12/1959 | Sweetman | 148/201 |
| 3,076,507 | A | * | 2/1963 | Sweetman | 166/169 |
| 4,116,130 | A | * | 9/1978 | Christopher et al. | 102/307 |
| 4,125,161 | A | | 11/1978 | Chamas | 166/297 |
| 4,315,797 | A | | 2/1982 | Peppers | |
| 4,413,677 | A | * | 11/1983 | Perkins | 166/120 |
| 4,498,367 | A | | 2/1985 | Skolnick et al. | |
| 4,512,399 | A | * | 4/1985 | Gano et al. | 166/120 |
| 4,582,134 | A | * | 4/1986 | Gano et al. | 166/120 |
| 4,598,769 | A | | 7/1986 | Robertson | 166/55 |
| 4,693,181 | A | | 9/1987 | Dadley et al. | |
| 5,000,426 | A | | 3/1991 | Champana | 266/48 |
| 5,322,118 | A | | 6/1994 | Terrell | 166/55 |
| 5,501,154 | A | | 3/1996 | Rodeny et al. | |
| 5,509,480 | A | * | 4/1996 | Terrell et al. | 102/275.11 |
| 5,720,344 | A | | 2/1998 | Newman | |
| 6,076,601 | A | * | 6/2000 | Mooney, Jr. | 166/297 |

* cited by examiner

*Primary Examiner*—David Bagnell
*Assistant Examiner*—Brian Halford
(74) *Attorney, Agent, or Firm*—William M. Imwalle; John F. Booth

(57) ABSTRACT

An apparatus and method for installing and removing packer assemblies from a subterranean well. A packer assembly has a stop that prevents the seal assembly from relaxing. The stop is cut axially by use of a chemically reactive cutter device lowered into the well and activated by use of conventional wire line equipment. Once cut, the seal assembly on the packer is allowed to relax and can be removed intact from the well.

62 Claims, 6 Drawing Sheets

RETRIEVABLE WELL PACKER APPARATUS AND METHOD

The present inventions relate to improvements in well packers used in sealing the annulus between a tubing string and the casing and methods therefore. More particularly, the present invention relates to packers, which can be easily removed from subterranean locations by use of wire line tools.

BACKGROUND OF THE INVENTIONS

Well packers are typically installed in wells to provide a seal for the annulus between the production or other tubing and the well casing. Packers have a tubular body sometime called a mandrel with an axial passageway for fluid flow. An expandable seal assembly and an axially operable seal actuator are positioned on the exterior of the typical packer. The packers are designed to be installed and left in the well for an extended period. Packers are connected to a tubing string, lowered into the well and set (installed) by mechanical means such as by pressure actuation of the seal actuators.

Removal of packers has been accomplished by cutting the packer body and allowing the seal assembly to relax (unset). Prior art methods used chemical and mechanical methods to cut through the wall of the packer body at an appropriate location. Problems with these methods included the need for special well service equipment, reliability and costs. Additionally, cutting through the packer allows the tubing string to fall into the well, requiring a subsequent fishing operation.

SUMMARY OF THE INVENTIONS

The present inventions contemplate an improved removal method and packer structure which can be removed using conventional wire line equipment and without allowing the string to fall into the well. The improved packer of the present invention has a tubular body with an exterior seal mechanism operated by an axially expandable actuator. For example, in a pressure-actuated packer, the actuator is an annular piston-cylinder set. In the present invention, an annular stop, preferably a nut, is connected to the packer body and limits axial movement of the axial actuator. A housing with an adjacent chamber substantially surrounds the stop. The stop is designed so that if it is cut axially, it will disengage from the packer body and allow the axial actuator to move which in turn allows the seal assembly to relax or disengage. Although not critical but desirable, the packer also prevents the stop from moving into a troublesome location. Preferably, the packer has internal locating structure such as a shoulder, key, or the like.

According to the improved method of the present inventions, the stop on the packer body is cut by use of a cutter positioned to cause minimal damage to the packer itself A cutter using a focused chemical reaction may be used. Chemical reactions that may be used in accordance with the invention include the application of chemical methods of focused chemical cutting, exothermic cutting, or an explosive charge.

For descriptions of linear cutting focused charges see: for examples, U.S. Pat. No. : 4,498,367; 4,693,181; and 5,501,154, which are incorporated herein for all purposes by reference and have desirable qualities for use in the present inventions. The chemical reaction can be the explosion of a charge arranged in a cutting pattern on a carrier. The carrier can be lowered into the well by wire line and is positioned inside the wire line body adjacent the annular stop. A conventional explosive cutting tool modified for the present use could be used. For example, the type shown in U.S. Pat. No. 5,720,344 could be modified to cut only through the stop, and thereafter used in this application. This patent is likewise incorporated herein for all purposes by reference. Positioning can be accomplished by numerous means such as depth measurement, locating structure in the packer, or the like. Once in proper position, the tool is activated, thereby severing or cutting the annular stop and releasing the packer seal assembly, thus allowing removal. The short axial cut necessary to disengage the stop does not destroy the integrity of the packer body allowing removal of the tubing string packer assembly intact.

For a description of a chemical cutter, see: for examples, U.S. Pat. Nos.: 5,322,118; 4,125,161; and 4,315,797, which are incorporated herein by reference and have desirable qualities adaptable for use in the present inventions. The chemical reaction can be a reaction between a chemical cutting agent and the material to be cut. A modification of a conventional chemical cutting tool could be used. For example, the type of downhole chemical cutter shown in U.S. Pat. No. 5,322,118 could be modified to produce a short axial cut, through the stop and thereafter used in this application. The carrier can be lowered into the well and positioned as described above. Once in the proper position, the chemical cutter is activated and the annular stop is severed or cut. As above, the short axial cut necessary to disengage the stop does not destroy the integrity of the packer body, allowing removal of the tubing string packer assembly intact.

For a description of an exothermic cutter, see: for examples, U.S. Pat. Nos.: 5,000,426 and 4,598,769, which are incorporated herein by reference and have desirable qualities adaptable for use in the present inventions. The chemical reaction used in the inventions can be an exothermic reaction producing a cutting flame directed through a port or nozzle. Again, the carrier can be lowered and positioned as described above in connection with the explosive charge cutter. An exothermic cutter, for example, of the type shown in U.S. Pat. No. 4,598,769, could be modified to cut axially through the stop, and thereafter used in this application. Once correctly positioned, the exothermic cutter is activated and the annular stop is severed or cut. The short axial cut necessary to disengage the stop does not destroy the integrity of the packer body, allowing removal of the tubing string packer assembly intact.

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used, and are not to be construed as limiting the inventions to only the illustrated and described examples. The various advantages and features of the present inventions will be apparent from a consideration of the drawings in which.

DETAILED DESCRIPTION

Figure 1:
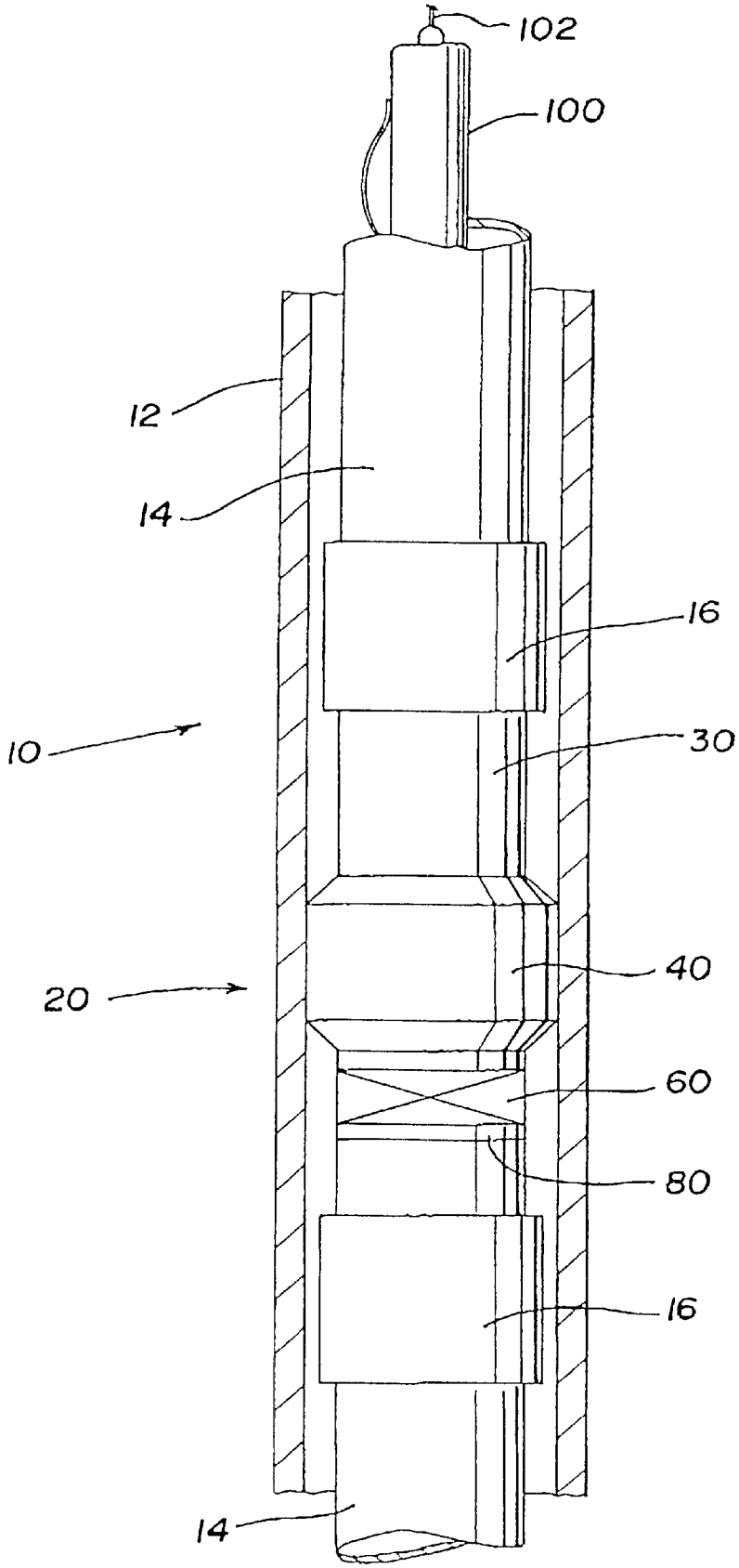
FIG. 1 is a side elevation view partially in section illustrating an embodiment tubing and packer assembly of the present invention shown installed in a subterranean location in a cased well.

The present inventions will be described by referring to drawings of apparatus and methods showing various examples of how the inventions can be made and used. In these drawings, reference characters are used throughout the several views to indicate like or corresponding parts. In FIG. 1, a portion of a subterranean well 10 is shown schematically in cross-section with a packer assembly 20 installed (set) therein. While wells commonly are laid out in a vertical direction as shown, it is understood that inclined and horizontal configurations exist. When the descriptive terms up and down are used with reference to a drawing, they are intended to indicate location on the drawing page and not necessarily orientation in the ground as the present inventions have utility no matter how the well bore is orientated. The subterranean well 10 has tubular well casing 12 in which is mounted a packer assembly 20 connected to well tubing 14 by threaded portions such as threaded connection 16. Packer assembly 20 is of the type having tubular mandrel or body 30 with an annular seal assembly 40 mounted on the exterior thereof. A remotely operable seal actuator assembly 60 is included on the body 30 and is used to expand the seal assembly into sealing contact with the interior wall to the well casing 12 to set the packer assembly 20 in the well. The actuator could be of any remotely actuated type including those mechanically or pressure actuated. An annular stop 80 is present to prevent the seal assembly 40 from relaxing from the expanded or set condition.

According to the present inventions, to remove the packer and tubing assembly, cutter carrier 100 is used (shown in FIG. 1 being lowered into the well casing 12 by wire line 102). Cutter carrier 100 is lowered into the packer assembly 20 to a position adjacent stop 80. Next, the cutter is actuated to axially cut the stop 80 through the wall of the packer to thereby allow the seal assembly 40 to relax and unset. This axial cutting of the stop does not destroy the integrity of the packer body 30, thus allowing the well tubing 14 and packer assembly 20 to be removed intact. In the preferred embodiment, a housing is present to catch the stop and prevent debris from falling into the well. The method and improved packer assembly of the present inventions are simple to remove from a well with conventional equipment.

Figure 2A:
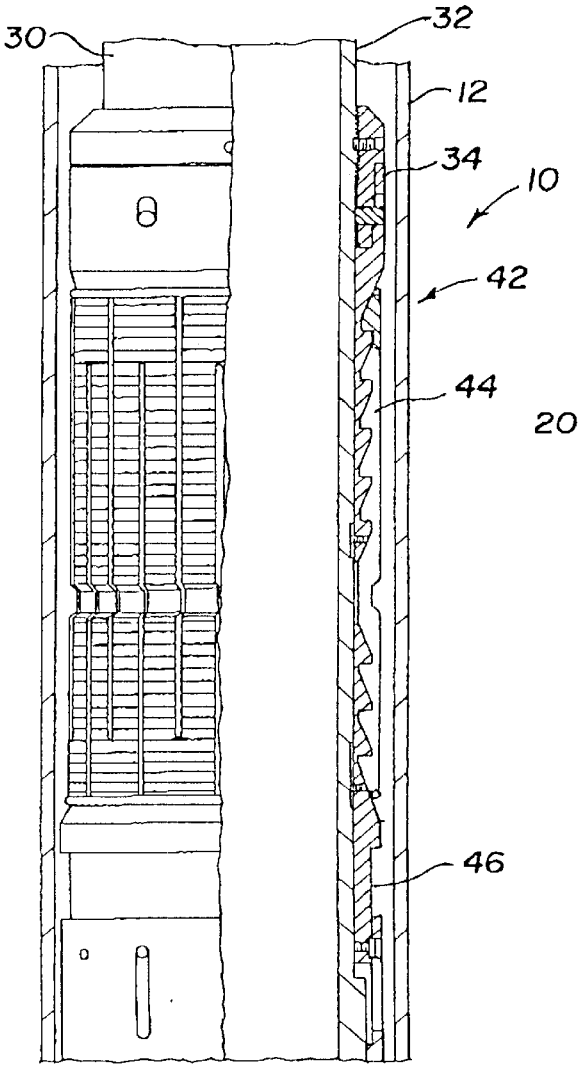
FIGS. 2A and B are horizontal sectional views illustrating an embodiment of the packer assembly of the present invention positioned inside a section of well casing and shown in the run-in or unexpanded position ready for installation in a subterranean location in a cased well.

The details of one embodiment of the present inventions will be described in reference to FIG. 2–FIG. 5. In FIGS. 2A and B, the improved packer assembly 20 is shown in the run in condition before it has been set in the well casing 12. Packer assembly 20 has a tubular body 30 of mandrel with a wall 32 defining a central passageway. An annular upper stop 34 is mounted (fixed against axial relative movement by a pin or the like) on the exterior of the body 30. The upper stop 34 acts with stop 80 to restrain the actuator assembly 60 and seal assembly 40 therebetween.

In the disclosed embodiment, the lower stop is selected to be cut to take advantage of the weight of the seal assembly 40 in unsetting or relaxing the packer assembly 20. It is envisioned the upper stop could be cut in addition to, or as an alternative to, the lower stop.

The upper end of the seal assembly 40 is restrained against axial movement by the upper stop 34. The lower end of the seal assembly 40 is operably connected to the upper end of the actuator assembly 60. The seal assembly 40, when axially compressed, will expand radially to contact the well casing 12 to seal the annulus between the packer and the casing. In the present embodiment, the seal assembly 40 comprises an upper wedge assembly 42 and a deformable assembly 50. The upper wedge assembly 42 has radially expandable slips 44. An axially movable sleeve 46 is positioned between the deformable assembly 50 and the upper end wedge assembly 42. The deformable assembly 50 has radially expandable seal elements 52 preferably of deformable seal material. The lower end of the deformable assembly 50 engages the upper end of the actuator assembly 60.

Figure 2B:
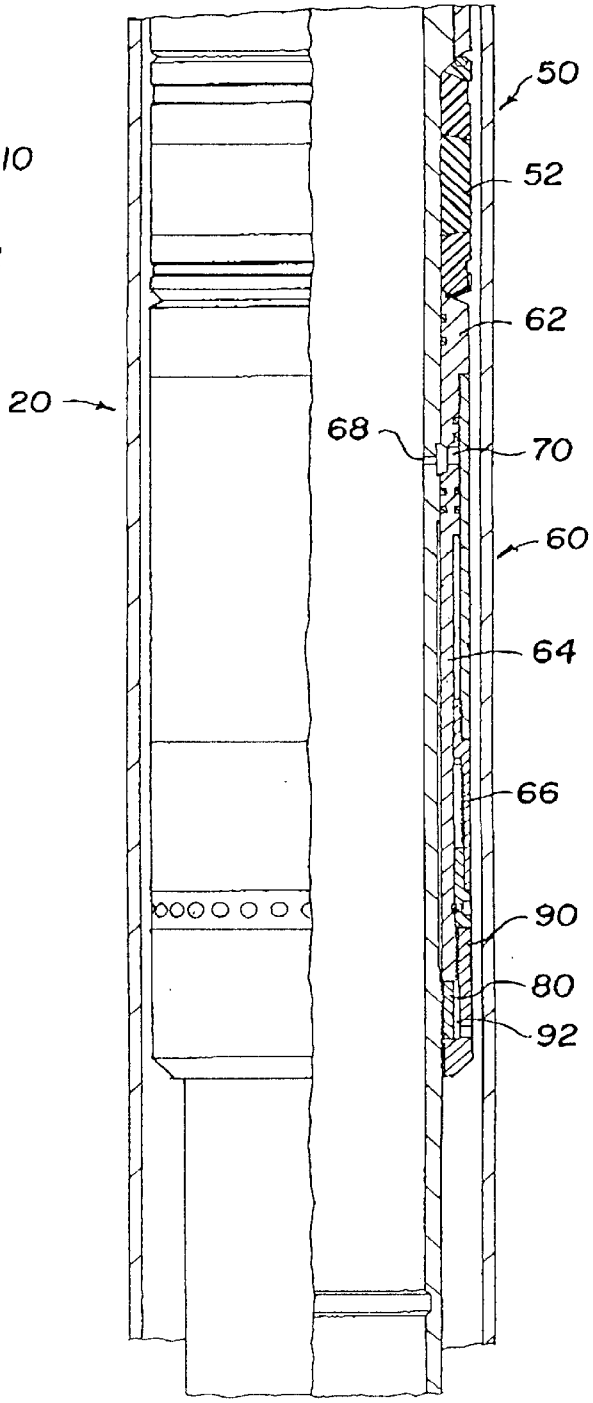

The actuator assembly 60 in this embodiment comprises an annular piston-cylinder assembly. The piston-cylinder assembly defines a variable volume chamber ported to the interior of the body 30. As shown in FIG. 2B, an axially movable annular cylinder 62 is positioned below and in contact with the lower end of seal assembly 40. The mating annular piston 64 is in a sliding fit on the exterior of body 30, but is restrained from movement by an annular stop 80.

In the present embodiment, stop 80 is in the form of a threaded nut engaging a mating threaded portion on the exterior of body 30. The stop 80 engages the lower end of the piston 64 and prevents downward axial movement. A housing 90 is mounted on the lower end of the piston 64. A chamber 92 is formed in housing 90, and is designed to be of a size to receive stop 80 therein.

Figure 3A:
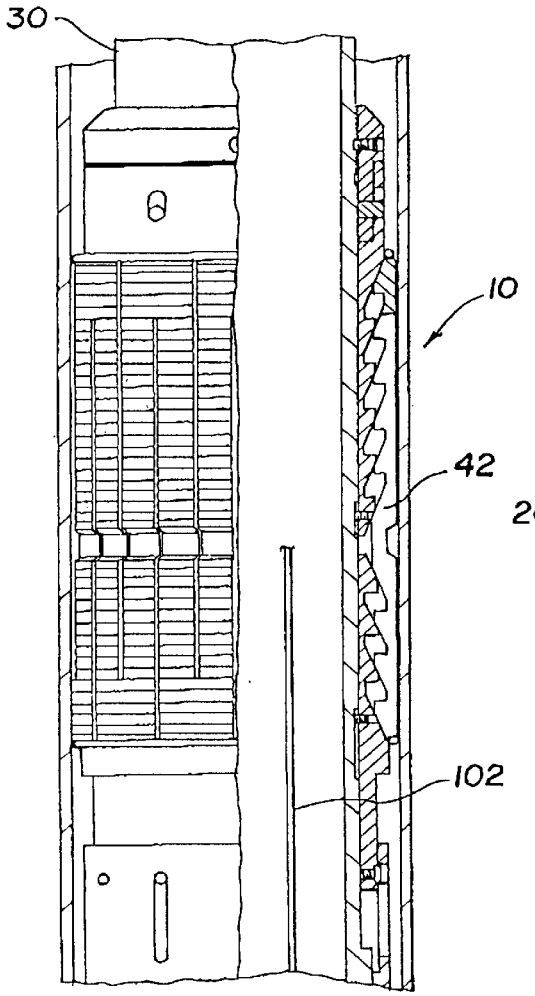
FIGS. 3A and B are horizontal sectional views similar to those of FIG. 2 illustrating an embodiment of the packer assembly of the present invention installed in a well with the seal assembly in the set or radially expanded condition.

In FIGS. 3A and B, the packer assembly 20 is shown in the actuated or set condition with the seal assembly 40 radially expanded to contact the interior of the well casing 12. In the configuration shown in FIGS. 2A and B, packer assembly 20 is in a condition for installation in the well. The installation or setting process is started by increasing the pressure within the body 30. The increased pressure is communicated through a port 68 to a variable volume chamber 70 defined between cylinder 62 and piston 64. As the pressure is increased, the volume of the chamber expands moving the cylinder 62 upward with respect to piston 64 to increase the effective axial length of the piston-cylinder assembly to axially compress the seal assembly 40. A ratchet 66 is positioned between cylinder 62 and piston 64 preventing contraction of the axial length of the piston-cylinder assembly. Expansion of the axial length of the piston-cylinder assembly continues until the seal assembly 40 is moved to the set condition shown in FIGS. 3A and B.

Figure 3B:
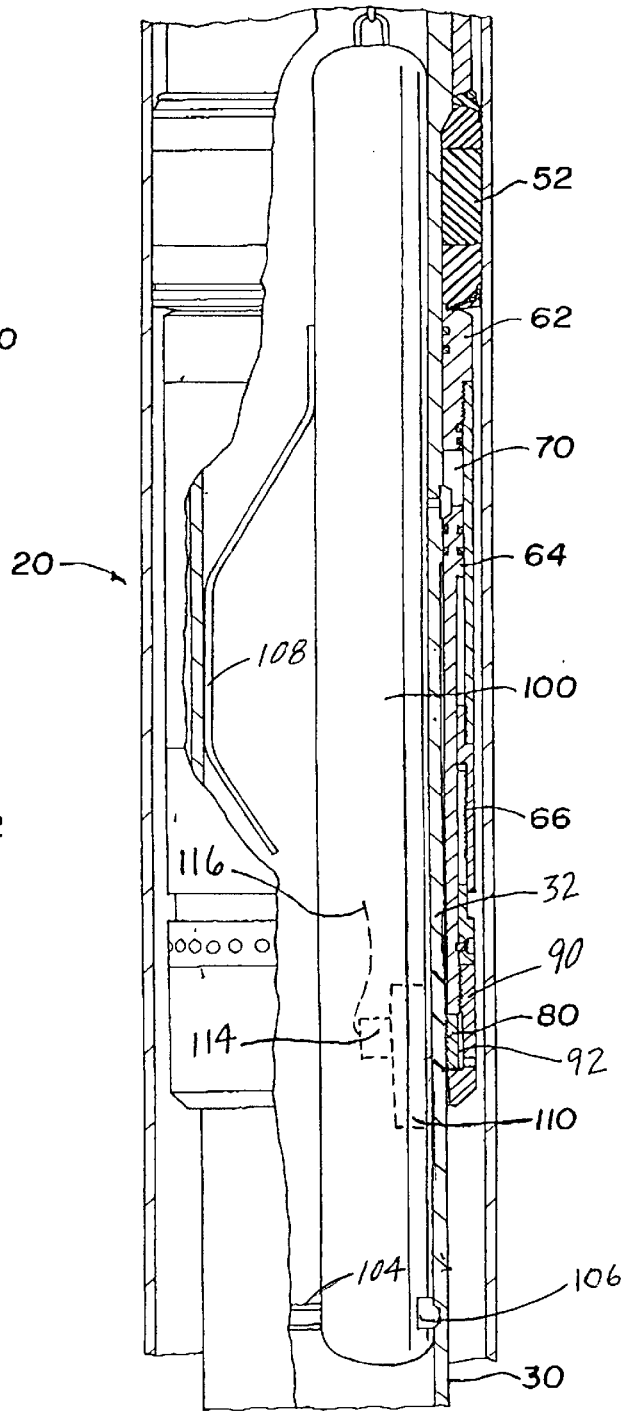

In FIGS. 4A–D, the packer assembly 20 is shown in the set or installed condition at the beginning step of the removal process. The carrier 100 has been lowered by wire line 102 into the packer assembly 20 to a location overlapping the stop 80. A spring 108 is shown, in FIG. 3B, on the carrier operable to position it against the wall 32. Alternatively, a magnetic force as described in U.S. Pat. No. 5,720,344, and incorporated herein, could be used. In the present embodiment, a locator surface 104 is formed in the interior of body 30, and is operable with locator 106 on carrier 100, as shown in FIG. 3B. However, any conventional locator configuration could be used as is well known in the industry. Axially locating the carrier 100 can, for example, be accomplished in the methods described in U.S. Pat. No. 5,720,344. Carrier 100 preferably (shown schematically in FIG. 3) has an explosive cutting charge 110 contained therein for cutting the stop 80. The charge contains remotely actuated igniters 114 (explosive caps and the like) so that the charge can be actuated when properly positioned. In the present embodiment, an electric conductor 116 to the surface with the wire line is connected to the charge igniter 114 to detonate the charge 110. Alternatively, the igniter 114 can be actuated by remote radio or other signal.

Linear focused charges are ideal for this method and the linear cutting need only be sufficient to axially cut the stop 80. Linear cutting charges are also preferred in that the resulting axial cut minimizes the damage to the integrity of the packer body 30 leaving it intact for easy removal. Preferably, a linear charge is used and arranged in an axially extending pattern on the carrier. The effective axial length of which is at least equal to the axial length of the stop 80. The circumferential extension of the charge pattern is preferably minimized to prevent severing the tubular body 30 of the packer to maintain it intact for removal. The explosive charge is selected to have sufficient strength to form a cut which penetrates the wall 32 and stop 80, but preferably does not penetrate housing 90 or damage the well casing 12. Preferably, the housing 90 acts as a shield to contain the explosion.

Figure 4A:
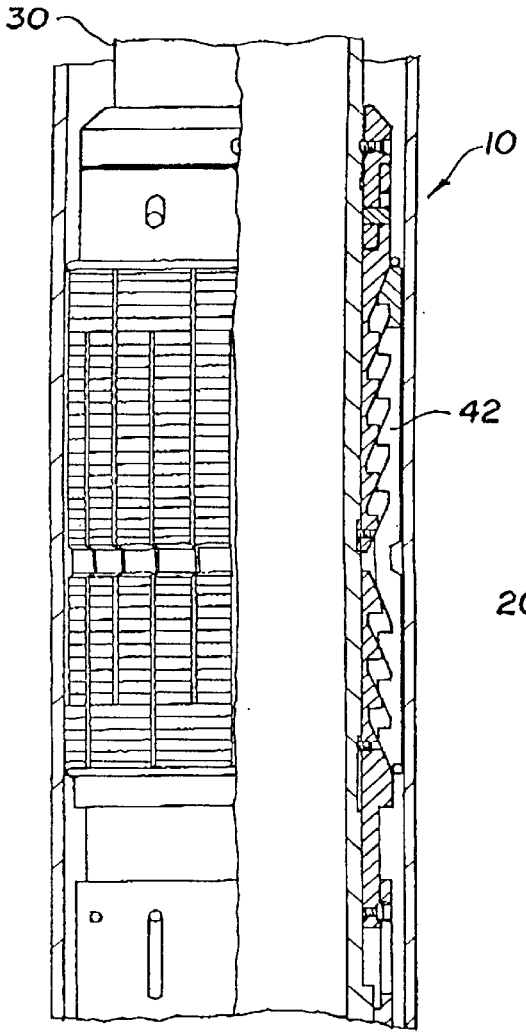
FIGS. 4A–D are horizontal sectional views similar to FIG. 2 illustrating an embodiment of the packer assembly of the present invention in a well with a stop-cutting tool positioned in the packer assembly.
Figure 4B:
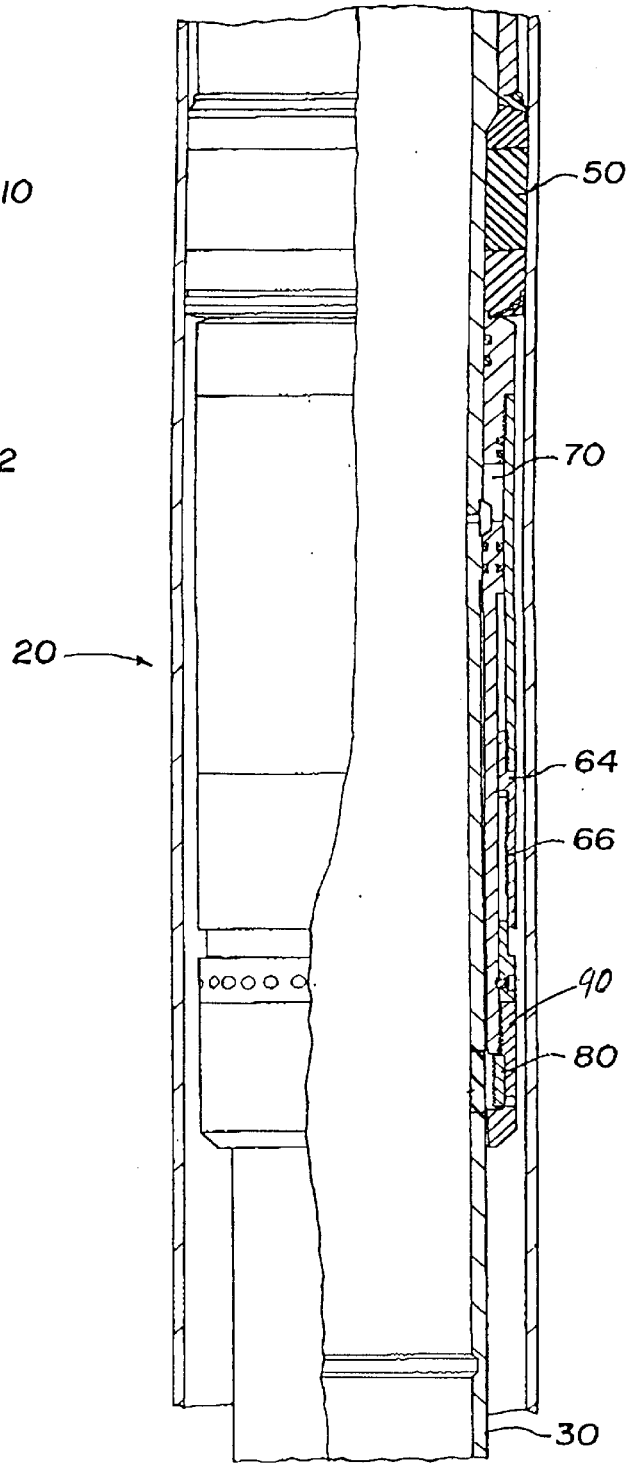
Figure 4C:
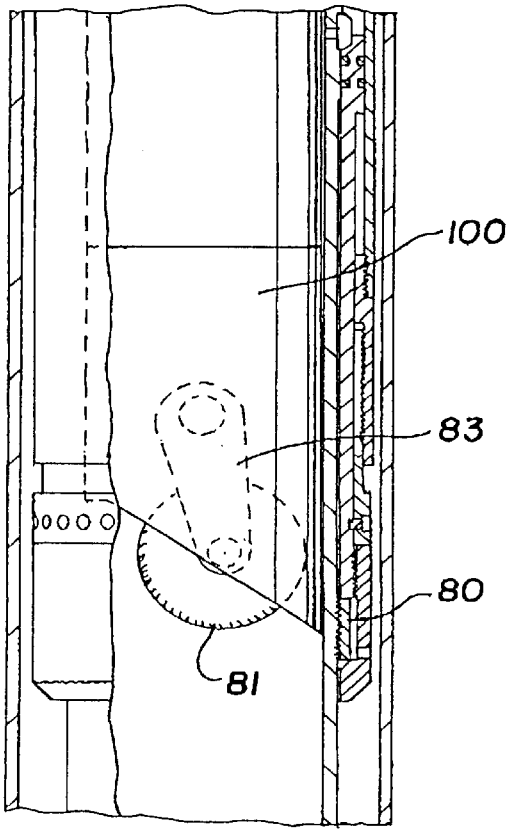

It will be apparent to those skilled in the art that the chemically reactive cutter used to make the cut need not be explosive. For example, the carrier 100 can be equipped with the components for producing a corrosive or exothermic chemical reaction sufficient to axially cut the stop 80. Optionally, a mechanical cutter may be used for axially cutting the stop 80. FIG. 4C depicts a mechanical cutter 81 in the run-in position.

Figure 4D:
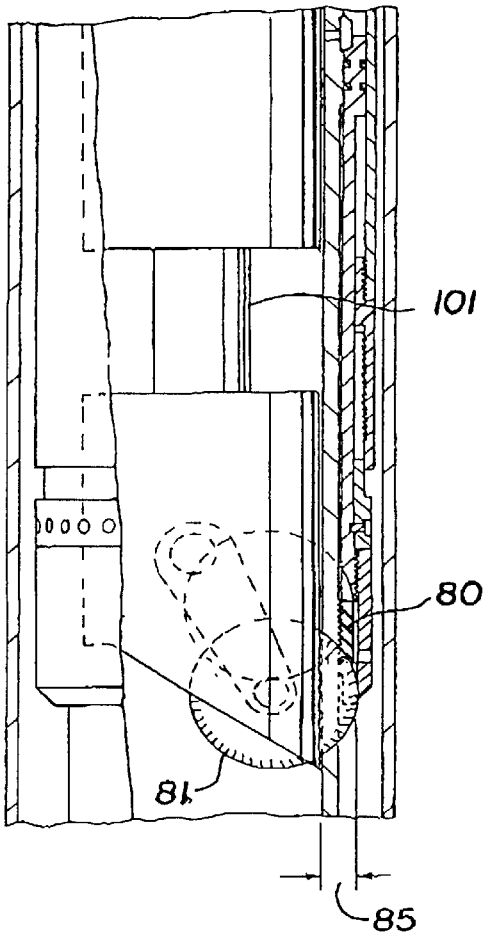

The mechanical cutter 81 is typically an electrically driven cutter-wheel 81 attached to a pivot arm 83 connected to the carrier 100. As shown in FIG. 4D, the cutter-wheel 81 pivot arm 83 is extendable for a controlled-depth cut shown by arrows 85. The length of the cut is controlled by the length of the mechanical cutter arm 101. In use, the cutter-wheel 81 is operably connected to an electric motor (not shown) preferably within the carrier 100. The carrier 100 is positioned adjacent the stop 80 to be cut. The cutter-wheel 81 is activated and the rapidly rotating cutter-wheel 81 is moved a predetermined distance by cutter arm 100 through the stop 80. After cutting, the cutter-wheel 81 is retracted to the run-in position.

As was previously pointed out, when stop 80 is cut, its threads disengage from the mating threads on the exterior of the body 30 allowing the stop 80 to move radially outward into chamber 92 and to slide axially on the body 30. Chamber 92 is of sufficient size to allow stop 80 to move radially outward a sufficient distance to disengage the threads. After the stop has been cut, the packer seal assembly can relax or contract radially. A lifting or upward force on the tubing string assists in unsetting the packer.

Figure 5A:
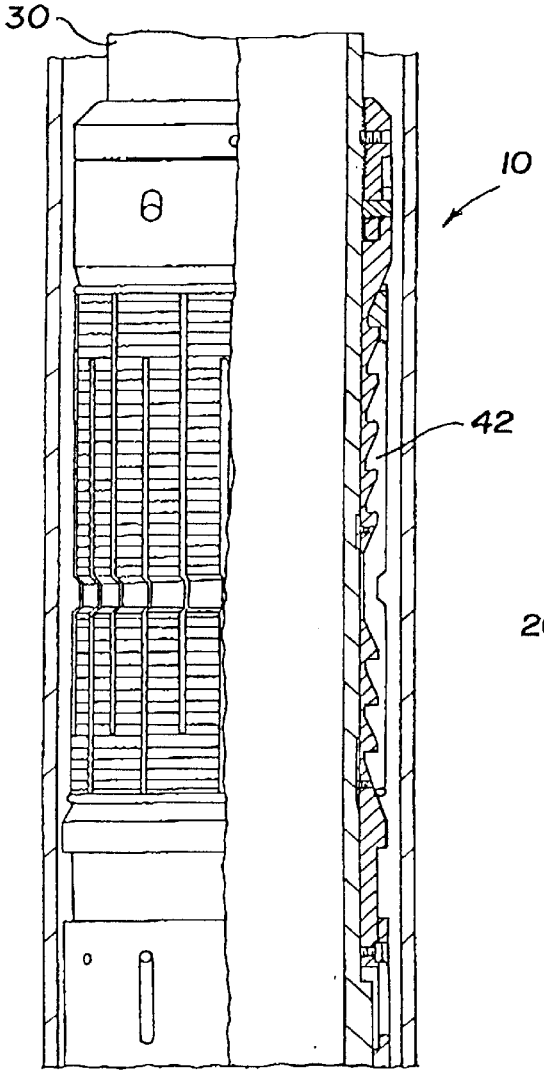
FIGS. 5A and B are horizontal sectional views similar to FIG. 2 illustrating an embodiment of the packer assembly of the present invention in a well with the packer stop-cut and the seal assembly in the relaxed condition ready for removal from the well with the tubing string.
Figure 5B:
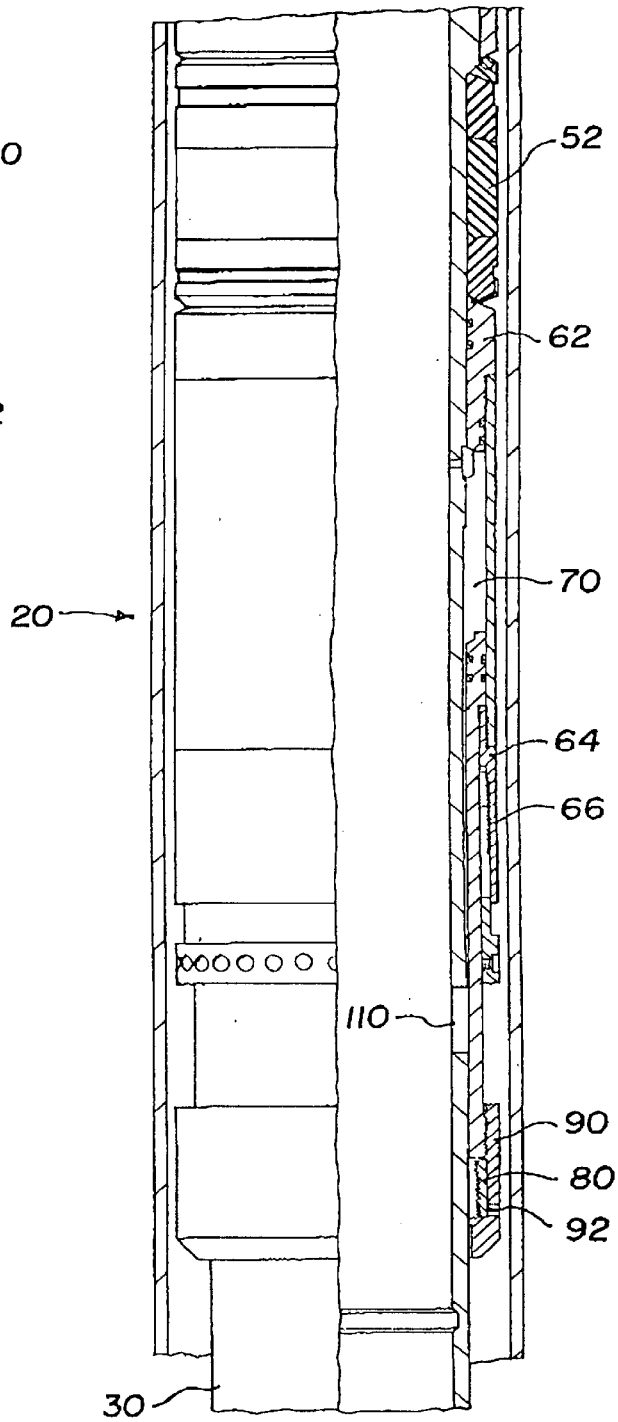

In FIG. 5, the packer assembly 20 is shown in the well after the cutting step and the carrier has been removed. As illustrated, an axially extending cut 110 has been formed in the wall 32, and the stop 80 has been severed. Stop 80 has moved into chamber 92. With the stop 80 cut, the piston 64 of the actuator assembly 60 is free to move axially downward as shown. The upper wedge assembly 42 and deformable assembly 50 of the seal assembly 40 have expanded axially and contracted away from the casing radially. With the packer assembly in the relaxed or unset condition, the tubing string packer assembly then can be easily removed from the well intact.

The embodiments shown and described above are only exemplary. Many details are often found in the art such as: packer assemblies, packer seals, packer actuators, explosives, charges and carriers, methods of chemically or mechanically cutting. Therefore, many such details are neither shown nor described. It is not claimed that all of the details of parts, elements, or steps described and shown were invented herein. Even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms using the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims:

What is claimed:

1. A method for removing a tubing assembly having an axially extending passageway from a well wherein the tubing assembly contains components of at least one tubular member and at least one packer assembly and wherein the packer assembly is held in the radially expanded condition by an annular stop on the packer assembly, the method comprising:

a. moving a cutter into the axial passageway to an activation position located adjacent the stop, b. retracting the packer from the radially expanded condition by activating the cutter in the appropriate position to disable the stop and thereby remove the stop and permit the packer to move out of the radially expanded position, wherein none of the components of the assembly are axially severed, and c. removing the tubing assembly from the well.

2. The method of claim 1 additionally comprising the step of arranging the cutter in an axially extending pattern before the moving step and wherein the pattern extends axially at least the axial length of the stop.

3. The method of claim 1 wherein the packer assembly has tubular body with the stop on the exterior of the body and wherein the retracting step comprises positioning the cutter inside the body and activating a cutter to form an axially extending cut through the body and stop to axially sever the stop.

4. The method of claim 1 wherein the packer assembly has a tubular body with the stop on the exterior of the body and wherein the disabling step comprises cutting the stop through the wall of the body without axially severing the body of the packer assembly to thereby maintain the structural integrity of the axial tubing string.

5. The method of claim 1 wherein the packer assembly has a tubular body and wherein the cutter cuts through the packer body without axially severing the packer body.

6. The method of claim 1 wherein the packer assembly has a tubular body and wherein the disabling step comprises axially cutting the annular stop along at least one side to sever the stop and radially moving the stop away from the body.

7. The method of claim 1 wherein the packer assembly has a tubular body and wherein the annular stop is a threaded nut engaging threads on the body.

8. The method of claim 1 wherein the packer has a tubular body and an axially movable actuator assembly connected thereto and wherein the stop limits axial movement of the actuator assembly.

9. The method of claim 1 wherein the cutter is a chemical cutter.

10. A method for removing a tubing assembly having an axially extending passageway from a well wherein the tubing assembly contains components of at least one tubular member and at least one packer assembly and wherein the packer assembly is held in the radially expanded condition by an annular stop on the packer assembly, the method comprising:

a. moving a chemically reactive cutter into the axial passageway to an activation position located adjacent the stop, b. retracting the packer from the radially expanded condition by activating the chemical reactive cutter in the appropriate position to disable the stop and thereby permit the packer to move out of the radially expanded position, wherein none of the components of the assembly are axially severed, and c. removing the tubing assembly from the well.

11. The method of claim 10 additionally comprising the step of arranging the chemically reactive cutter in an axially extending pattern before the moving step and wherein the pattern extends axially at least the axial length of the stop.

12. The method of claim 10 wherein the packer assembly has tubular body with the stop on the exterior of the body and wherein the retracting step comprises positioning the chemically reactive cutter inside the body and activating a chemical reaction to form an axially extending cut through the body and stop to axially sever the stop.

13. The method of claim 10 wherein the packer assembly has tubular body with the stop on the exterior of the body and wherein the disabling step comprises cutting the stop through the wall of the body without axially severing the body of the packer assembly to thereby maintain the structural integrity of the axial tubing string.

14. The method of claim 10 wherein the packer assembly has a tubular body and wherein the chemical reactive cutter cuts through the packer body without axially severing the packer body.

15. The method of claim 10 wherein the packer assembly has a tubular body and wherein the disabling step comprises axially cutting the annular stop along at least one side to sever the stop and radially moving the stop away from the body.

16. The method of claim 10 wherein the packer assembly has a tubular body and wherein the annular stop is a threaded nut engaging threads on the body.

17. The method of claim 10 wherein the packer has a tubular body and an axially movable actuator assembly connected thereto and wherein the stop limits axial movement of the actuator assembly.

18. The method of claim 10 wherein the chemically reactive cutter further comprises an explosive charge.

19. The method of claim 10 wherein the chemically reactive cutter further comprises a corrosive chemical cutter.

20. The method of claim 10 wherein the chemically reactive cutter further comprises an exothermic chemical cutter.

21. A method for removing a packer assembly from a well wherein the packer assembly has an axially extending passageway and is held in the radially expanded condition by an annular stop on the packer assembly, the method comprising:

a. moving a chemically reactive cutter into the axial passageway to a reaction position located adjacent the stop with the cutter capable of producing a chemical reaction extending at least the axial length of the stop, b. retracting the packer from the radially expanded condition by activating the chemical reaction in the appropriate position to create a cut and disable the stop and thereby permit the packer to move out of the radially expanded position, wherein the cut is not an endless circumferential cut, and c. removing the packer assembly from the well.

22. The method of claim 21 additionally comprising the step of arranging the chemically reactive cutter in an axially extending pattern before the moving step and wherein the pattern extends axially at least the axial length of the stop.

23. The method of claim 21 wherein the packer assembly has a tubular body with the stop on the exterior of the body and wherein the retracting step comprises positioning the chemically reactive cutter inside the body and activating the chemical reaction to form an axially extending cut through the body and stop to axially sever the stop.

24. The method of claim 21 wherein the packer assembly has tubular body with the stop on the exterior of the body and wherein the disabling step comprises cutting the stop through the wall of the body without axially severing the body of the packer assembly to thereby maintain the structural integrity of the packer body.

25. The method of claim 21 wherein the chemical reaction cuts through the packer assembly without axially severing the packer assembly.

26. The method of claim 21 wherein the packer assembly has a tubular body and wherein the disabling step comprises axially cutting the annular stop along at least one side to sever the stop and radially moving the stop away from the body.

27. The method of claim 21 wherein the annular stop is a threaded nut engaging threads on the packer assembly.

28. The method of claim 21 wherein the packer has a tubular body and an axially movable actuator assembly connected thereto and wherein the stop limits axial movement of the actuator assembly.

29. The method of claim 21 wherein the chemically reactive cutter further comprises an explosive charge.

30. The method of claim 21 wherein the chemically reactive cutter further comprises a corrosive chemical cutter.

31. The method of claim 21 wherein the chemically reactive cutter further comprises an exothermic chemical cutter.

32. A method of installing and removing a tubing assembly having an axially extending passageway from a well wherein the tubing assembly contains components of at least one tubular member and at least one packer assembly and wherein the packer assembly moves between a retracted and a radially expanded position, the method comprising:

a. moving the tubing assembly into the well, b. radially expanding the packer assembly and holding the packer in the expanded position by an annular stop on the packer, c. moving a chemically reactive cutter into the axial passageway to a reaction position located adjacent the stop with the cutter capable of producing a chemical reaction sufficient to axially cut the stop, d. retracting the packer from the radially expanded condition by activating the chemical reaction in the appropriate position to create a cut and disable the stop and thereby permit the packer to move out of the radially expanded position, wherein the cut is not an endless circumferential cut, and e. removing the tubing assembly from the well.

33. The method of claim 32 additionally comprising the step of arranging the chemically reactive cutter in an axially extending pattern before the moving step and wherein the pattern extends axially at least the axial length of the stop.

34. The method of claim 32 wherein the packer assembly has a tubular body with the stop on the exterior of the body and wherein the retracting step comprises positioning the chemically reactive cutter inside the body and activating the chemical reaction to form an axially extending cut through the body and stop to axially sever the stop.

35. The method of claim 32 wherein the packer assembly has a tubular body with the stop on the exterior of the body and wherein the disabling step comprises cutting the stop through the wall of the body without axially severing the body of the packer assembly to thereby maintain the structural integrity of the packer body.

36. The method of claim 32 wherein the chemical reaction cuts through the packer assembly without axially severing the packer assembly.

37. The method of claim 32 wherein the packer assembly has a tubular body and wherein the disabling step comprises axially cutting the annular stop along at least one side to sever the stop and radially moving the stop away from the body.

38. The method of claim 32 wherein the packer assembly has a tubular body and wherein the annular stop is a threaded nut engaging threads on the body.

39. The method of claim 32 wherein the packer has a tubular body and an axially movable actuator assembly connected thereto and wherein the stop limits axial movement of the actuator assembly.

40. The method of claim 32 wherein the chemically reactive cutter further comprises an explosive charge.

41. The method of claim 32 wherein the chemically reactive cutter further comprises a corrosive chemical cutter.

42. The method of claim 32 wherein the chemically reactive cutter further comprises an exothermic chemical cutter.

43. A packer assembly for installation and removable from a well by use of an axially extending cutter comprising:

a. a tubular body, b. a radially expandable member carried by the body movable between a retracted and radially expanded condition, c. an axially movable actuator assembly operably associated with the radially expandable member for moving the radially expandable member into the radially expanded condition, d. an annular stop connected to the body and operable to hold the expandable member in the expanded condition, and e. a housing carried by the body surrounding the annular stop having an annular clearance chamber formed in the housing of a size to permit the annular stop to move radially away from the body and into the clearance chamber when the stop is axially cut to thereby allow the expandable member to move to the retracted condition and be removed from the well.

44. The packer of claim 43 wherein

The tubular body has a wall defining a passageway extending axially through the tubular body of a size to receive a cutter and wherein the wall thickness adjacent the stop permits penetration through the wall to cut the stop.

45. The packer of claim 43 wherein the annular stop is a threaded nut engaging threads on the body.

46. The packer of claim 43 wherein the axially movable actuator assembly comprises an annular piston-cylinder assembly.

47. The packer of claim 43 wherein the piston cylinder assembly is axially spaced from the annular stop a sufficient distance to avoid damage thereto from the cutting of the stop.

48. The packer of claim 43 wherein the cutter is a chemical reactive cutter.

49. A packer assembly for installation and removable from a well by use of an axially extending chemically reactive cutter comprising:

a. a tubular body, b. a radially expandable member carried by the body movable between a retracted and radially expanded condition, c. an axially movable actuator assembly operably associated with the radially expandable member for moving the radially expandable member into the radially expanded condition, d. an annular stop connected to the body and operable to hold the expandable member in the expanded condition, and e. a housing carried by the body surrounding the annular stop having an annular clearance chamber formed in the housing of a size to permit the annular stop to move radially away from the body and into the clearance chamber when the stop is axially cut by a chemical reaction to thereby allow the expandable member to move to the retracted condition and be removed from the well.

50. The packer of claim 49 wherein the tubular body has a wall defining a passageway extending axially through the tubular body of a size to receive a chemically reactive cutter and wherein the wall thickness adjacent the stop permits penetration of the chemical reaction through the wall to cut the stop.

51. The packer of claim 49 wherein the annular stop is a threaded nut engaging threads on the body.

52. The packer of claim 49 wherein the axially movable actuator assembly comprises an annular piston-cylinder assembly.

53. The packer of claim 49 wherein the piston cylinder assembly is axially spaced from the annular stop a sufficient distance to avoid damage thereto from the cutting of the stop.

54. The packer of claim 49 wherein the chemically reactive cutter further comprises an explosive charge.

55. The packer of claim 49 wherein the chemically reactive cutter further comprises a corrosive chemical cutter.

56. The packer of claim 49 wherein the chemically reactive cutter further comprises an exothermic chemical cutter.

57. A method of removing from a well a tubing assembly having an axially extending passageway, and components of at least one tubing member and at least one packer assembly, in a radially expanded position, the method comprising the steps of:

a. moving a cutter into the axial passageway to an activation position, b. activating the cutter to cut in an axially extending patter, wherein none of the components of the assembly are axially severed, thereby permitting the packer assembly to move out of the radially expanded position; and c. removing the tubing assembly from the well.

58. The method of claim 57 wherein the step of activating further comprises cutting in an axially extending pattern of substantially a vertical line.

59. The method of claim 57 wherein the packer assembly has a tubular body with a stop on the exterior of the body and wherein the activating step further comprises cutting the stop, thereby disabling the stop.

60. The method of claim 59 wherein the stop is a threaded nut engaging mating threads on the tubular body.

61. The method of claim 59 wherein the activating step further comprises axially severing the stop.

62. The method of claim 59 further comprising the step of radially moving the stop away from the tubular body.

* * * * *